United States Patent [19]

Satake et al.

[11] Patent Number: 4,997,460

[45] Date of Patent: Mar. 5, 1991

[54] ABRASIVE ROLL AND METHOD OF PRODUCING THE SAME

[75] Inventors: Toshihiko Satake, Higashihiroshima; Satoru Satake, Tokyo; Takamasa Mesaki, Fukayasu, all of Japan

[73] Assignee: Satake Engineering Co., Ltd., Tokyo, Japan

[21] Appl. No.: 380,071

[22] Filed: Jul. 14, 1989

[30] Foreign Application Priority Data

Jul. 19, 1988 [JP] Japan ..... 63-181298

[51] Int. Cl.[5] ..... B24D 3/00

[52] U.S. Cl. ..... 51/293; 51/296; 51/307; 51/308; 51/309

[58] Field of Search ..... 51/293, 296, 307, 308, 51/309

[56] References Cited

U.S. PATENT DOCUMENTS

| | | | |
|---|---|---|---|
| 3,416,905 | 12/1968 | Waugh | 51/296 |
| 4,086,067 | 4/1987 | Busch et al. | 51/309 |
| 4,494,964 | 1/1985 | Ohlsson et al. | 51/309 |

*Primary Examiner*—William R. Dixon, Jr.
*Assistant Examiner*—Willie J. Thompson
*Attorney, Agent, or Firm*—Darby & Darby

[57] ABSTRACT

A method of producing an abrasive roll comprises the steps of forming a mixture of substances such as abrasive grains, a bond, a temporary caking agent and a pore forming agent, molding the mixture into a body having a predetermined shape, and drying and then burning the body. The pore forming agent is constituted from a rice hull powder sieved to have a predetermined particle size, thereby enabling to produce an abrasive roll of high porosity which has pores having substantially ball-like shape and substantially uniform size and includes a bond having portions of high $SiO_2$ concentration each adjacent to and surrounding one of the pores.

3 Claims, No Drawings

ABRASIVE ROLL AND METHOD OF PRODUCING THE SAME

BACKGROUND OF THE INVENTION

1. Field Of The Invention

The present invention relates to an abrasive roll and a method of producing the same.

2. Description Of The Prior Art

It has hitherto been known that a method of producing an abrasive roll for use with rice polishing machines, for example, ordinarily comprises the step of forming a mixture of substances such as abrasive grains, a bond and a temporary caking agent, and that the formation of the mixture is effected, taking amounts or proportions of these respective substances into consideration. Also it has been known that a powder or a dust of substances such as polystyrene, foamed styrol, wood, cork and walnut is sometimes added into the mixture as a pore forming agent.

The abrasive roll produced without using the pore forming agent has a low porosity and suffers from an inferior polishing efficiency. When the grain percentage of an abrasive roll is increased with a view to attaining an improved polishing efficiency, the grade of the abrasive roll lowers. The abrasive roll having a low grade is impossible to be used for the rice polishing since partial wear thereof would occur during the polishing operation. Further, in the case where the powder or the dust of the abovementioned substances is used as the pore forming agent, it is difficult to enhance strength of the bond bridging and bonding the abrasive grains and hence to enhance the grade of the abrasive roll. The abrasive roll having the bond of low strength can be used for polishing rice at high efficiency only at an initial stage of the rice polishing operation. Since the strength of the bond and hence the grade are low, the bond may be broken, causing abrasive grains to be separated from the abrasive roll. This makes the surface portion of the abrasive roll rough and disadvantageously causes broken rice grains to be produced during the rice polishing.

The porosity of an abrasive roll may be increased by adjusting the molding pressure. However, the molding pressure adjustment is not effective for forming pores of uniform size and for preventing formation of pores of large size more than 500 μm. The rice polishing with the use of the abrasive roll with the pores of such large size may disadvantageously cause the rice grains to be broken.

SUMMARY OF THE INVENTION

It is therefore an object of the invention to provide an abrasive roll which may be preferably used for the rice polishing without accompanying the disadvantages of the prior art described hereinabove.

It is another object of the invention to provide a method of producing such abrasive roll.

According to an aspect of the invention, there is provided a method of producing an abrasive roll comprising: forming a mixture of abrasive grains, a bond, a temporary caking agent and a pore forming agent, said pore forming agent essentially consisting of a rice hull powder sieved to have a predetermined particle size; molding the mixture into a body having a predetermined shape; and drying and then burning the body.

According to another aspect of the invention, there is provided an abrasive roll produced by such method.

The above and other objects, characteristic features and advantages of the invention will become more apparent from the description on an embodiment of the invention given hereinafter.

DETAILED DESCRIPTION OF THE EMBODIMENT

An embodiment of the invention will be described hereunder.

In this embodiment, abrasive grains may be constituted from such substances as SiC (silicon carbide) and $Al_2O_3$ (alumina), and a powder of such substances as feldspar, pottery stone and clay may be used as a bond or bonding material thereof. A temporary, i.e. burnable, caking agent may be constituted by starch obtained from potatoes. Further, a pore forming agent is constituted from a powder of rice hull sieved to have a predetermined particle size which is appropriately selected in consideration of a use of an abrasive roll to be produced.

In this embodiment, the abrasive grains, bond, pore forming agent and temporary caking agent are mixed together and agitated in a mixing machine. For example, 100 weight parts of the abrasive grains, 50 weight parts of the bond, 3 to 8 weight parts of the pore forming agent, 0.8 weight parts of the temporary caking agent and about 12 weight parts of cold and hot waters are mixed together and agitated. For example, 30- to 60-mesh powder of rice hull is used as the latter pore forming agent for producing in an abrasive roll pores of the corresponding size.

A mixture obtained by the abovementioned mixing and agitating process is sieved with the use of a swingable sieve to have a predetermined particle size, and then pressed as being gradually flown into a metal mold of a suitable shape placed in a molding machine. A molded body formed by the molding operation in the molding machine is then placed in a drying furnace and dried therein for about two days by a hot air in the furnace which has a temperature of about 80° to 90° C. Thereafter, the molded body is burnt or fired in a burning or firing furnace continuously for about 70 hours. In the burning furnace, the molded body is burnt at gradually increased temperatures, and near the final stage of the burning process the temperature reaches about 1300° C. and the molded body is burnt at the latter temperature during the final stage for 7 to 8 hours. The molded body thus burnt is dried under the atmosphere for about one week, and then an outer periphery thereof and the other parts required are cut and ground to obtain an abrasive roll constituting a final product.

It is to be noted that the rice hull powder constituting the pore forming agent consists of substances such as cellulose, lignin, hemicellulose, hydrocarbon and silica. When the hull powder is burnt, gases such as $N_2$, CO, $CO_2$, $H_2$, $CH_4$, $C_2H_4$, and $O_2$ are generated. An amount of ash produced by the burning of the hull powder is about 16% by weight of the hull powder to be burnt. The produced ash contains $SiO_2$ in an amount of about 95% by weight of the entire ash, and the balance consisting of substances such as CaO, MgO, $Na_2O$, $Fe_2O_3$ and $P_2O_5$.

Since the gases are generated during burning of the hull powder, an abrasive roll of high porosity may be produced. Further, the pores formed in a structure of the abrasive roll have spherical or substantially ball-like shape and substantially uniform size or diameter. Furthermore, since $SiO_2$ in the abovementioned amount is contained in the ash produced by the burning of the hull powder, the concentration of $SiO_2$ at the portions of the bond each adjacent to and surrounding one of the pores, i.e., at interfaces between the pores and the bond, is enhanced. Consequently, an abrasive roll of high porosity which has a high bond strength and a high grade may be produced. Since the abrasive roll produced has a high bond strength and a high grade it is suitable to use as an abrasive roll for the rice polishing for which high strength and improved grinding properties are required. Further, according to the invention, it is possible to produce an abrasive roll for the precision grinding by using as the pore forming agent the hull powder sieved to have a particle size appropriate for this purpose.

As will be apparent from the foregoing description, according to the invention, a rice hull powder sieved to have a predetermined particle size is used as a pore forming agent. This enhances the porosity of the abrasive roll produced, and hence improves polishing efficiency of the abrasive roll by preventing the pores from being clogged with dusts produced by the polishing operation. Further, since the abrasive roll according to the invention has high $SiO_2$ concentration at the interfaces between the bond and the pores, the strength of the bond and the grade are increased and hence separation of the abrasive grains from the abrasive roll is suppressed. Furthermore, the pores have substantially ball-like shape and uniform size. Consequently, the abrasive roll fit for various uses requiring improved grinding properties may be obtained. For example, the abrasive roll which may be preferably used for the rice polishing without producing broken rice grains is obtainable.

What is claimed is:

1. A method of producing an abrasive roll comprising:

forming a mixture of abrasive grains, a bonding material, a temporary caking agent and a pore forming agent, said pore forming agent essentially consisting of a rice hull powder sieved to have a predetermined particle size, and said caking agent temporarily caking the mixture for molding it into a body of predetermined shape;

molding said mixture into a body having a predetermined shape; and drying and then burning said body.

2. Method of claim 1 wherein by weight said mixture contains about 3–8 parts of the pore forming agent per 100 parts of the abrasive grains.

3. A method of producing an abrasive roll comprising:

forming a mixture by weigh of about 100 parts abrasive grains constituted from silicon carbide or alumina, about 50 parts of a bonding material, about 0.8 part of a starch containing caking agent and about 3–8 parts of a pore forming agent, said pore forming agent essentially consisting of a rice hull powder sieved to have a predetermined particle size;

molding said mixture into a body having a predetermined shape; and drying and then burning said body.

* * * * *

UNITED STATES PATENT AND TRADEMARK OFFICE

CERTIFICATE OF CORRECTION

PATENT NO. : 4,997,460

DATED : March 5, 1991

INVENTOR(S) : Toshihiko Satake, Satoru Satake, Takamasa Mesaki

It is certified that error appears in the above-identified patent and that said Letters Patent is hereby corrected as shown below:

Title page,

Item [21] "Appl. No. 380,071" should read - - Appl. No. 380,170 - -

Signed and Sealed this

Twentieth Day of October, 1992

*Attest:*

DOUGLAS B. COMER

*Attesting Officer*

*Acting Commissioner of Patents and Trademarks*